US006158572A

United States Patent [19]

Butler et al.

[11] Patent Number: 6,158,572

[45] Date of Patent: Dec. 12, 2000

[54] WATER DRIVEN ROLLER FOR HOT STRIP MILL SIDEGUIDES

[75] Inventors: Kirk C. Butler, Seven Hills; Eric F. Wadsworth, Richfield; James K. McCormick, Valley View, all of Ohio

[73] Assignee: LTV Steel Company, Inc., Cleveland, Ohio

[21] Appl. No.: 09/127,155

[22] Filed: Jul. 31, 1998

[51] Int. Cl.[7] ..... B65G 29/00

[52] U.S. Cl. ..... 198/624; 198/722; 198/782

[58] Field of Search ..... 198/624, 722, 198/782, 577

[56] References Cited

U.S. PATENT DOCUMENTS

| | | | |
|---|---|---|---|
| 558,202 | 4/1896 | McNicol . | |
| 714,758 | 12/1902 | Sundt . | |
| 1,733,379 | 10/1929 | Lowry . | |
| 2,215,231 | 9/1940 | Redshaw . | |
| 2,714,440 | 8/1955 | Forty et al. . | |
| 3,090,477 | 5/1963 | Luek et al. . | |
| 3,371,770 | 3/1968 | Grahame et al. . | |
| 3,844,399 | 10/1974 | Sellers et al. . | |
| 3,994,327 | 11/1976 | Bergholm et al. | 198/722 |
| 4,441,536 | 4/1984 | Rautio | 198/624 |
| 4,554,958 | 11/1985 | Schmidt . | |
| 4,593,809 | 6/1986 | Zapletal et al. | 198/624 |
| 4,750,853 | 6/1988 | Van Soest et al. . | |
| 4,907,632 | 3/1990 | Reuter . | |
| 5,228,558 | 7/1993 | Hall | 198/784 |
| 5,558,202 | 9/1996 | Miller et al. . | |
| 5,730,279 | 3/1998 | Judge | 198/624 |
| 5,915,429 | 6/1999 | Pelletier et al. | 198/782 |

*Primary Examiner*—Douglas Hess
*Attorney, Agent, or Firm*—Watts, Hoffman, Fisher & Heinke, Co., L.P.A.

[57] ABSTRACT

A roller assembly adapted to be mounted to a conveyor sideguide for use in directing a strip of steel along a conveyor. The roller assembly includes a roller member having a plurality of flutes spaced apart on outer surface of the roller. The roller assembly also includes a support assembly featuring a roller support assembly in which the roller member is rotatably supported and a mounting assembly for securing the roller member to the sideguide such that the roller extends beyond an inner surface of the conveyor sideguide facing the steel strip. The roller assembly further includes a fluid manifold which directs a source of pressurized liquid directed at the roller to sequentially impinge each of the plurality of flutes and cause the roller member to rotate with respect to the roller support assembly at a predetermined angular velocity, the angular velocity of the roller automatically adjusting to correspond to a linear velocity of the steel strip when an edge of the steel strip contacts the roller member. The roller assembly support further includes a ball bearing assembly disposed between the roller member and a stationary pin of the roller support assembly.

24 Claims, 8 Drawing Sheets

WATER DRIVEN ROLLER FOR HOT STRIP MILL SIDEGUIDES

FIELD OF THE INVENTION

The present invention relates to a roller assembly for a conveyor sideguide in a hot strip rolling mill and, more particularly, a water driven roller assembly for a conveyor sideguide used to direct hot strips of steel along a conveyor in a hot strip rolling mill operation.

BACKGROUND OF THE INVENTION

In the production of steel coils in a hot strip rolling mill, hot strips of steel are transported along a roller table or conveyor between processing stations wherein the strips are reduced to an appropriate thickness and ultimately coiled into a roll by a downcoiler. As the hot strip of steel moves along the conveyor it is crucial that the strip be properly directed to remain on the conveyer. To this end, sideguides are positioned along the conveyor edges to direct the steel strip and prevent it from running off the conveyor. During processing, the steel strip can travel at linear velocities along the conveyor of between 700 and 2700 ft/min. Unfortunately, it has been found that when the moving steel strip contacts the stationary wear plates of the sideguides, the edges of the steel strip can be damaged in terms of edge abrasion, deformation and rolled in defects in the resulting steel coil.

What is needed is an assembly that reduces the damage to edges of steel strips as the strips are transported or directed along a conveyor by the sideguides.

SUMMARY OF THE INVENTION

In accordance with the present invention, roller assembly mounted on a sideguide of a conveyor for directing a strip of steel is disclosed. The roller assembly includes a roller member, a support assembly and a manifold for directing a source of pressurized fluid onto the roller member to rotate the roller member at a desired angular velocity. The roller member is a rotatable cylindrical shaped member having a fluted outer surface. The pressurized fluid impinges on the flutes of the roller member to rotate the roller.

The support assembly includes a roller support assembly for rotatably supporting the roller member and a pivot assembly for pivoting the roller member between two positions, a contacting position and a noncontacting position. In the contact position, at least one roller member on each side of the conveyor extend beyond inwardly facing surfaces of the sideguides and contacts the edge of the steel strip. In a noncontacting position, the roller members are out of contact with the steel strip.

The manifold includes a housing defining an interior area and a nozzle plate having a plurality of angled openings or jets. Fluid such as water is injected into the housing interior and the angled openings or jets act as nozzles directing the water at the roller flutes to rotate the roller member. Advantageously, the roller support assembly includes a pair of ball bearing assemblies providing a low resistance to rotation of the roller within the roller support assembly.

The pressure of the fluid in the manifold housing may be adjusted to attain a desired angular velocity of the roller member. Since the roller member is rotating when contacted by an edge of a steel strip, damage to the steel strip edge will be minimized. Further, since the drive linkage between the pressurized water source and the roller flutes constitute an indirect drive linkage, the roller member operates as a self clutching mechanism, that is, when the edge of the steel strip contacts the roller member, the roller member will change its angular velocity appropriately to rotate at an angular velocity that corresponds to the instantaneous linear velocity of the steel strip at the time of contact. Further, for so long as the steel strip edge remains in contact with the roller member, the roller member will change angular velocity to conform to any variations in the instantaneous linear velocity of the steel strip on the conveyor.

Advantageously, the roller assembly of the present invention eliminates edge abrasion of the steel strip and rolled in defects because the steel strip edges contact respective rollers members, to the sideguide wear plates. Further, the roller assemblies eliminate costly sideguide wear plate maintenance. Additionally, the roller assembly of the present invention eliminates the need for a conventional gear driven system for the roller assembly which reduces space requirements for the roller. Finally, the self clutching, indirect drive feature of the roller assembly eliminates the need for speed control of the angular velocity of the roller.

In one aspect of the invention, a roller assembly for use in directing a steel strip along a conveyor having a conveyor sideguide is disclosed. The roller assembly comprises:

a) a roller member comprising at least one roller driving surface;

b) a support assembly including:

i) a roller support assembly that rotatably supports the roller member; and ii) mounting assembly means for securing the roller assembly with respect to the conveyor and for positioning the roller member such that the roller member can be contacted by an edge of the steel strip; and c) means for directing pressurized liquid at the roller member to impinge upon said at least one roller driving surface and cause the roller to rotate with respect to the roller support assembly.

Preferably, the at least one roller driving surface includes a plurality of spaced apart flutes in the roller driving surface and the means for directing pressurized liquid at the roller member comprises a liquid supply conduit and a nozzle plate disposed between said supply conduit and said roller member, wherein said nozzle plate includes a plurality of openings that are configured and arranged to direct the pressurized liquid at said at least one roller driving surface.

These and other objects, features and advantages of the invention will become better understood from the detailed description of the preferred embodiments of the invention which are described in conjunction with the accompanying drawings.

DETAILED DESCRIPTION

Figure 1:
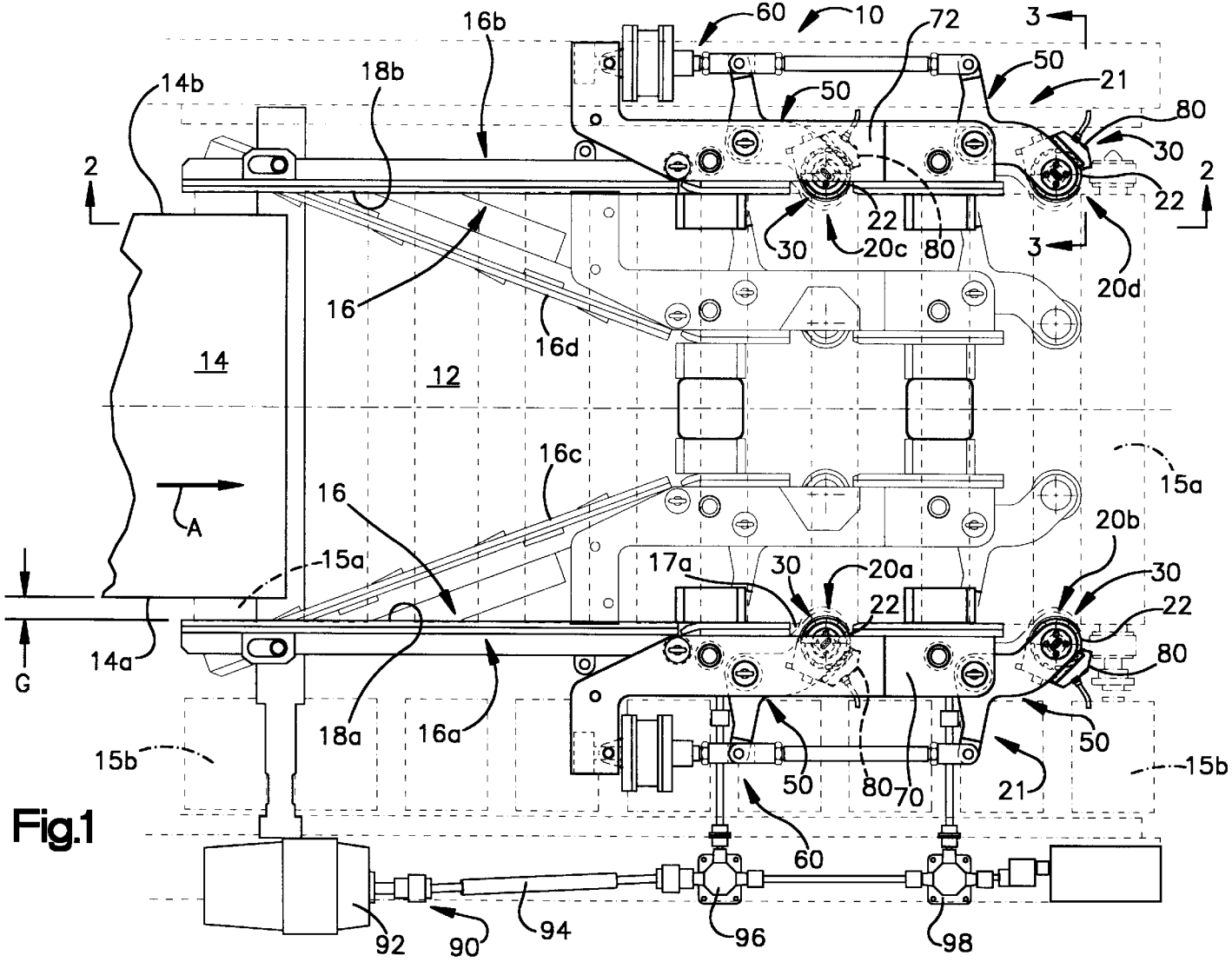
FIG. 1 is a top plan view of a portion of a hot strip rolling mill conveyor with a sideguide assembly including four of the roller assemblies of the present invention.
Figure 2:
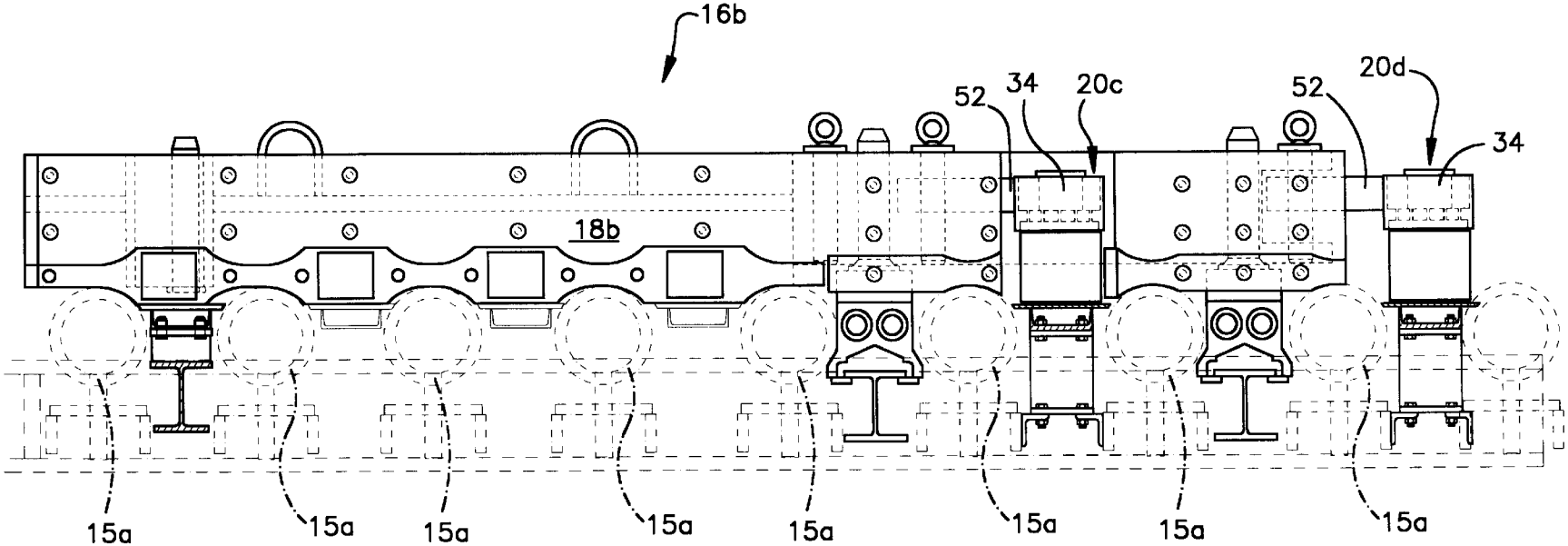
FIG. 2 is a sectional view of one side of the hot strip rolling mill conveyor sideguide showing two of the roller assemblies as seen from a plane indicated by the line 2—2 in FIG. 1.
Figure 4:
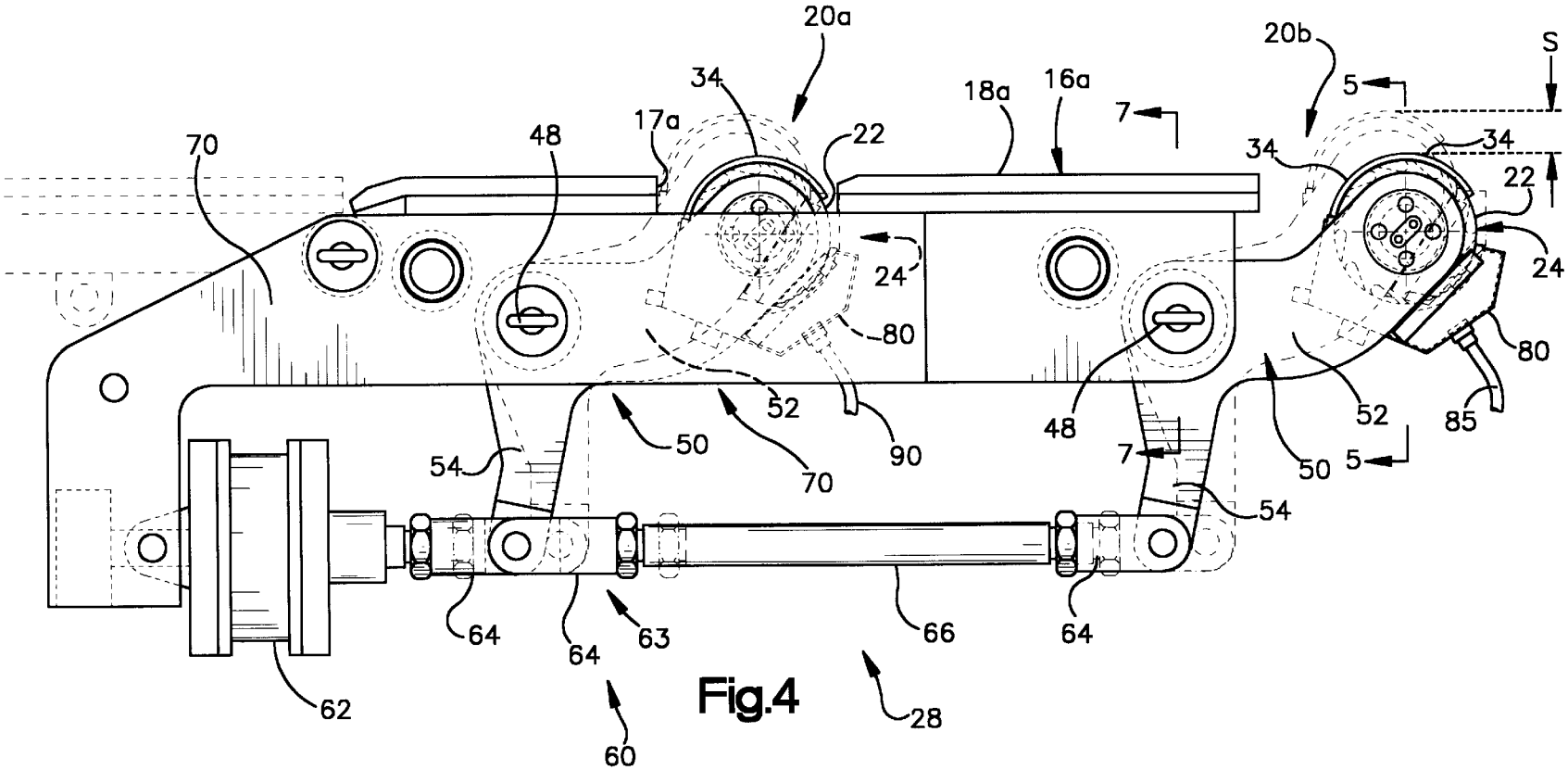
FIG. 4 is an top plan view of two of the roller assemblies mounted on one of the conveyor sideguides.

FIG. 1 shows a top plan view of a portion of a hot strip rolling mill line 10. The line 10 includes a roller table or conveyor 12 which is traversed by a strip of steel 14 en route to a downcoiler (not shown) which coils the steel strip into a roll. The strip 14 starts as a metal slab (for example, a 9 inch slab) and is formed into a strip by the rolling mill line 10. The conveyor 12 is comprised of a plurality of power rollers 15*a* driven by motors 15*b* (a small portion of the conveyor 12 shown in dashed line in FIG. 1). To direct or guide the steel strip 14 along the conveyor 12, a sideguide assembly 16 is provided. The sideguide assembly 16 includes vertical sideguides 16*a*, 16*b* disposed along the outer edges of the conveyor 12. The sideguides 16*a*, 16*b* include friction wear plates 18*a*, 18*b*. Four roller assemblies 20*a*, 20*b*, 20*c* and 20*d* of the present invention are mounted to the sideguides 16*a*, 16*b*. Specifically, two of the roller assemblies 20*a*, 20*b* are pivotally mounted to a roller guide frame 70, while the other two roller assemblies 20*c*, 20*d* are pivotally mounted to a roller guide frame 72. The roller guide frames 70, 72, in turn, are mounted to respective sideguides 16*a*, 16*b*. FIG. 2 shows a portion of the vertical sideguide 16*b* including wear plates 18*b* and the roller assemblies 20*c*, 20*d*. FIG. 4 shows a portion of sideguide 16*a* including wear plates 18*a* and the roller assemblies 20*a*, 20*b*.

Different widths of steel strips 14 are processed by the line 10. In one exemplary embodiment of the line 10, steel strip 14 ranging in width from 24 inches to 78 inches and in thickness from 0.070 inches to 0.625 inches are processed. To accommodate different widths of steel strips, the vertical sideguides 16*a*, 16*b* are horizontally adjustable (i.e., adjustable horizontally in the plane of the paper in FIG. 1) by a sideguide drive mechanism 90. The sideguide drive mechanism 90 includes a motor 92, a constant velocity universal spindle 94 and gear boxes 96, 98. The extremes of horizontal movement in the sideguides 16*a*, 16*b* are shown in FIG. 1. The solid line drawing of sideguides 16*a*, 16*b* shows the maximum width position of the sideguides, accommodating a 78 inch width steel strip. Shown in phantom in FIG. 1 is the minimum width position of the sideguides 16*a*, 16*b*, accommodating a 24 inch width steel strip.

When a new steel strip 14 having a different width is to be processed by the mill line 10, a funnel shaped portion (shown in phantom at 16*c*, 16*d* in FIG. 1) of the sideguides 16*a*, 16*b* roughly center the strip in the middle of the conveyor 12 in the parallel sideguide portion downstream of the funnel shaped portion. Then, the sideguide drive mechanism 90 moves the sideguides 16*a*, 16*b* horizontally such that the wear plates 18*a*, 18*b* are about 2 inches away from the respective edges 14*a*, 14*b* of the steel strip 14. That is, the distance labeled G in FIG. 1 is approximately 2 inches. The roller assemblies 20*a*, 20*b*, 20*c*, 20*d* each include a support assembly 21 (FIGS. 1 and 4). The support assembly 21 includes a pivot assembly 28 permitting a respective roller member 22 of each of the roller assemblies 20*a*, 20*b*, 20*c*, 20*d* to pivot between two positions, a noncontacting position and a contacting position. The noncontacting position of the roller members 22 is shown in solid line FIGS. 1 and 4, and in this position, the roller members 22 of the roller assemblies 20*a*, 20*b*, 20*c*, 20*d* extend slightly inwardly of the sideguide wear plates 18*a*, 18*b* but do not contact the steel strip edges 14*a*, 14*b* (unless the strip 14 runs about 2 inches off center).

Once the steel strip 14 is centered on the conveyor 12 and the sideguides 16*a*, 16*b* are properly positioned about 2 inches away from the edges 14*a*, 14*b*, the roller members 22 of the roller assemblies 20*a*, 20*b*, 20*c*, 20*d* are pivoted into the contacting position, shown in dashed line in FIGS. 1 and 4. In this position, the roller members 22 of each of the respective roller assemblies 20*a*, 20*b*, 20*c*, 20*d* contact the steel strip edges 14*a*, 14*b*. As a result, in the contacting position, the sideguide wear plates 18*a*, 18*b* are protected from contact with the steel strip edges 14*a*, 14*b*.

As will be explained in further detail below, the roller assemblies 20*a*, 20*b*, 20*c*, 20*d* each include a roller member 22, the support assembly 21 (including a roller support assembly 30 and a pivot assembly 50) and a fluid manifold 80. For each of the roller assemblies 20*a*, 20*b*, 20*c*, 20*d*, a roller member 22 is rotated by water routed through a respective manifold 80 and directed upon the roller members 22. Thus, the roller members 22 are rotating when pivoted into contact with the edges 14*a*, 14*b* of the moving steel strip 14 (the strip 14 is moving between 700 and 2700 feet/minute along the conveyor 14 toward the downcoiler in the direction labeled with the arrow A in FIG. 1).

The rotation of the roller members 22 when initially contacting the steel strip 14 greatly eliminates edge abrasion of the steel strip and rolled in defects. Further, the roller assemblies 20*a*, 20*b*, 20*c*, 20*d* eliminates costly sideguide wear plate maintenance. Additionally, the roller assemblies roller members 22 being rotated by water pressure eliminate the need for a conventional gear drive system for the roller members 22 of the roller assemblies 20*a*, 20*b*, 20*c*, 20*d*. The elimination of a gear drive system reduces space requirements for the roller assemblies. Finally, because the roller members 22 are water driven instead of gear driven, the roller members have a self clutching, indirect drive. This indirect drive of the roller members 22 means that the roller members 22 will automatically adjust their angular velocity of rotation, $\omega$, to match the linear speed of the steel strip 14.

The support assembly 21 of each of the roller assemblies 20*a*, 20*b*, 20*c*, 20*d* includes the roller support assembly 30 (FIGS. 1 and 4) for rotatably supporting roller member 22 and the pivot assembly 50 for pivoting the roller member 22 between the contacting and noncontacting positions. Each of the roller assemblies 20*a*, 20*b*, 20*c*, 20*d* are identical in structure and, therefore, only roller assembly 20*b* and 20*d* will be described in detail, it being understood that the description applies to each of the other roller assemblies.

Figure 3:
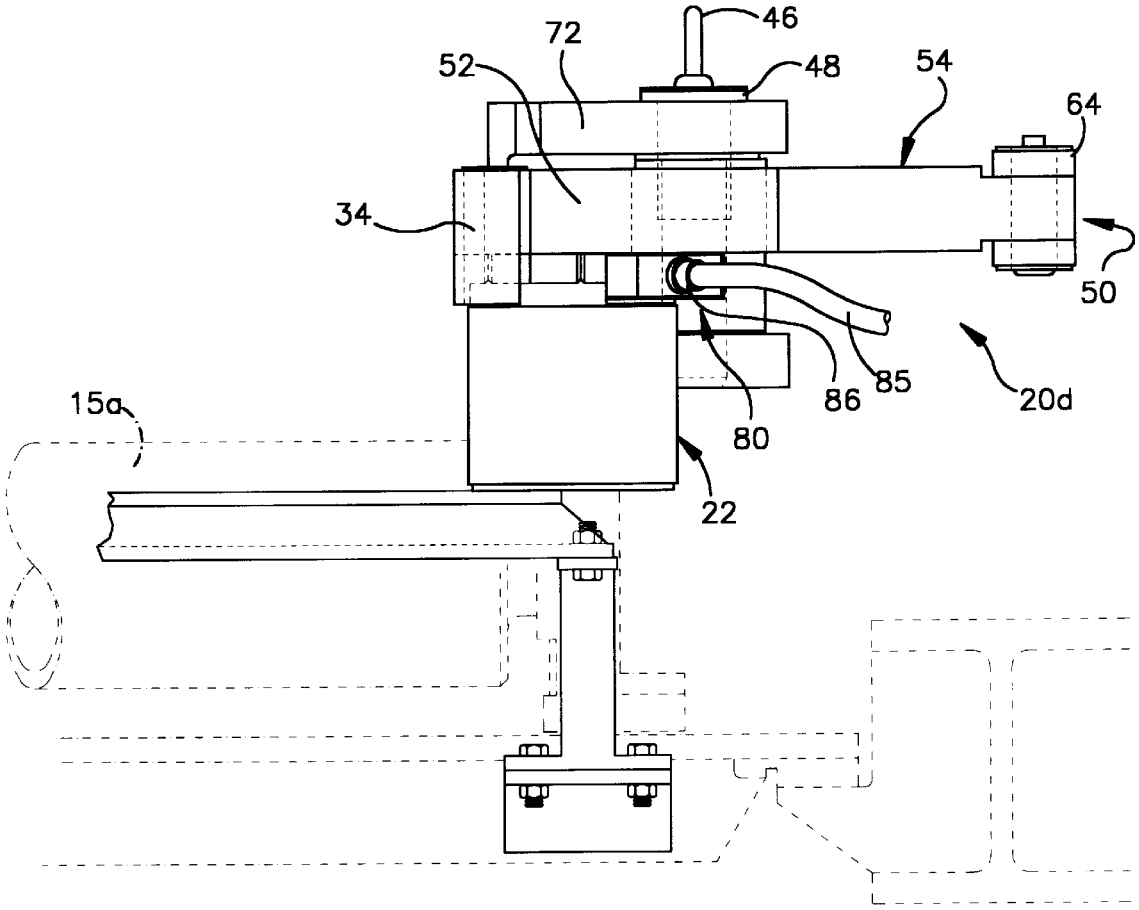
FIG. 3 is a sectional view of the side of the conveyor sideguide as seen from a plane indicated by the line 3—3 in FIG. 1.
Figure 5:
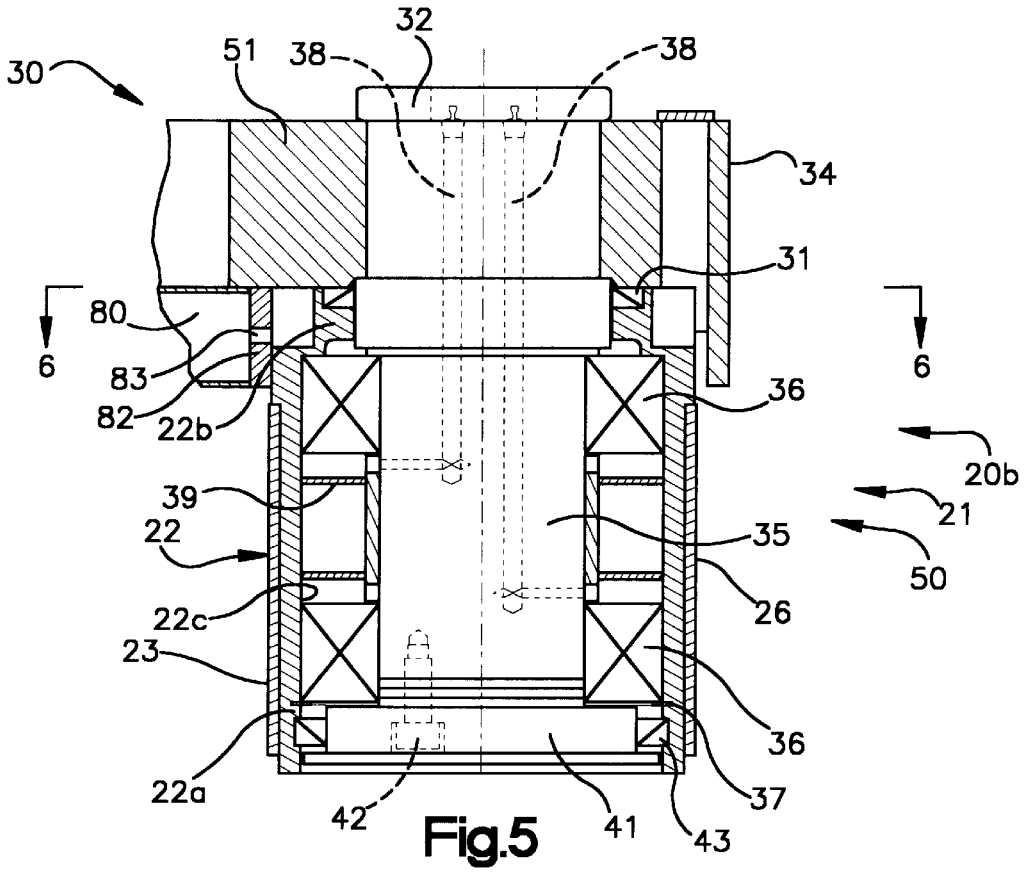
FIG. 5 is a sectional view of a roller assembly of the present invention as seen from a plane indicated by the line 5—5 in FIG. 4.

As can be best be seen in FIGS. 4 and 5, the roller assembly 20*b* includes comprised of the roller support assembly 30 and the pivot assembly 28. The roller assembly 20*b* includes the cylindrical shaped roller member 22 comprised of roller 22*a* and an outer sleeve 26. An upper portion of the roller 22*a* is protected by a roller shroud 34 (best seen in FIGS. 3 and 4). Preferably, the roller 22*a* is comprised of 4140 alloy steel tubing annealed to 180–200 Brinell and the outer sleeve 26 is comprised of 4140 alloy steel quenched and tempered to 300–350 Brinell and, after machining, the sleeve 26 is nitride hardened to 50–60 Rockwell.

Figure 6:
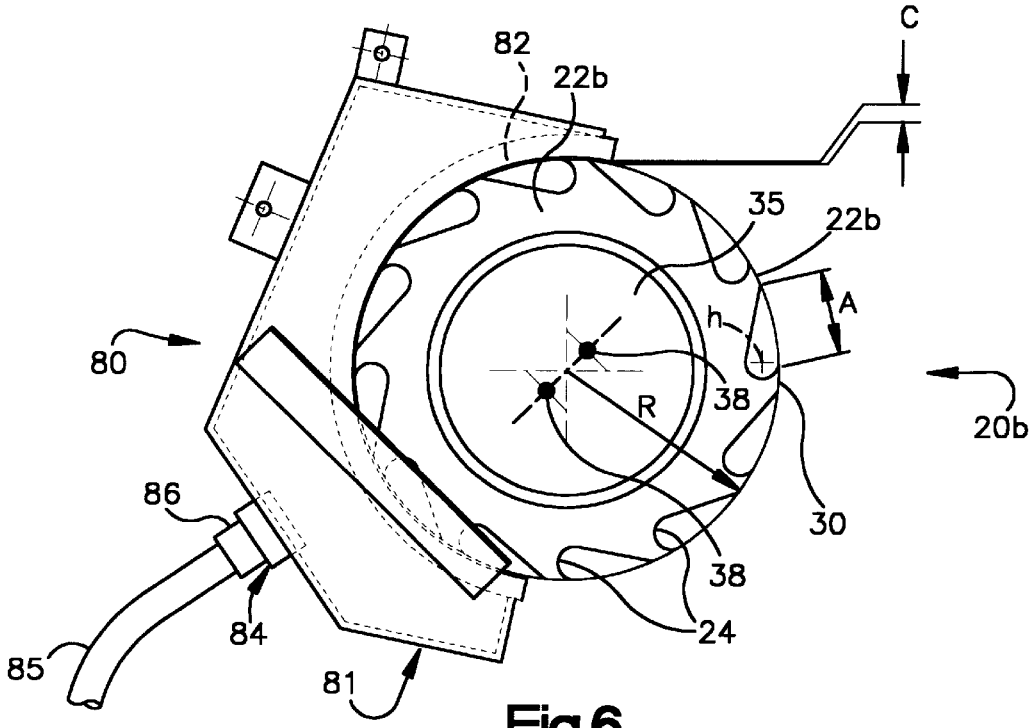
FIG. 6 is a sectional view of the roller assembly as seen from a plane indicated by the line 6—6 in FIG. 5.

The roller 22*a* preferably has an outer diameter (OD) of 9.505 inches in the region where the outer sleeve 26 overlies the roller 22*a* and an OD of 10 inches above the sleeve 23. The roller 22*a* has an overall height of 11⅝ inches. The outer sleeve 23 has an OD of 10¼ inches and a height of 8¹¹⁄₁₆ inches. An upper region 22*b* (best seen in FIG. 6) of the roller 22*a* includes a plurality of equally spaced apart fins or flutes 24, preferably twelve in an outer periphery of the roller 22*a*. The flutes 24 are milled into the outer periphery and are curved, having a teardrop shape with a radius of ⅜ inch in the circular portion of the flute (labeled as h in FIG. 6). Other dimensions in FIG. 6 include R=5.04 inches and A=2.0 inches. The clearance C between the outer periphery of the upper section 22*b* and a nozzle plate 82 of the manifold 80 is approximately 0.04 inches. This allows for drainage of the water impinging on the roller flutes 24. The water directed from the manifold 80 onto the roller flutes 24 drains to a sump, where it is filtered and recycled for use in the rolling mill operation.

The roller member 22 is rotatably supported by the roller support assembly 30 including a shaft 35. The roller support assembly 30 includes a lower end plate 41 which is bolted to the shaft 35 by a hex head cap screw 42 (⁵⁄₁₆-11×1⅝" long), the hex head of the screw 42 which fits into a recess in the lower end plate 41. A Chicago Rawhide (CR) (Type HDS2) seal 43 seals between the lower end plate 41 and the roller 22*a*. The CR seal 43 is 7¼ inch ID×8¾ inch OD×⅝ inch wide. An upper end plate 32 is disposed above the shaft 35. Another Chicago Rawhide (CR) (Type CRWHA1) seal 31 (FIG. 5) seals between the shaft 35 and the roller upper section 22*b*. The CR seal 31 is 6 inch ID×7½ inch OD×½ inch wide.

Positioned between the roller 22 and a stationary inner pin 25 are two spaced apart sets of roller bearings 36, preferably Torrington double row spherical roller bearings having dimensions of 4.7244 inches ID, 8.4646 inches OD and 2.2835 inch width. A retaining ring 37 (FIG. 5) is disposed in an peripheral slot in an inner surface 22*c* of the roller 22*a* to hold the lower roller bearing set in place. An annular spacer 39 is disposed between the roller inner surface 22*c* and the inner pin 25. A pair of lubrication holes 38 through the inner pin 25 and the upper end plate 32 are provided for lubrication of the sets of roller bearings 36. The lubrication holes 38 terminate in alemite lubrication fittings 40 disposed in the upper end plate 32.

Figure 10:
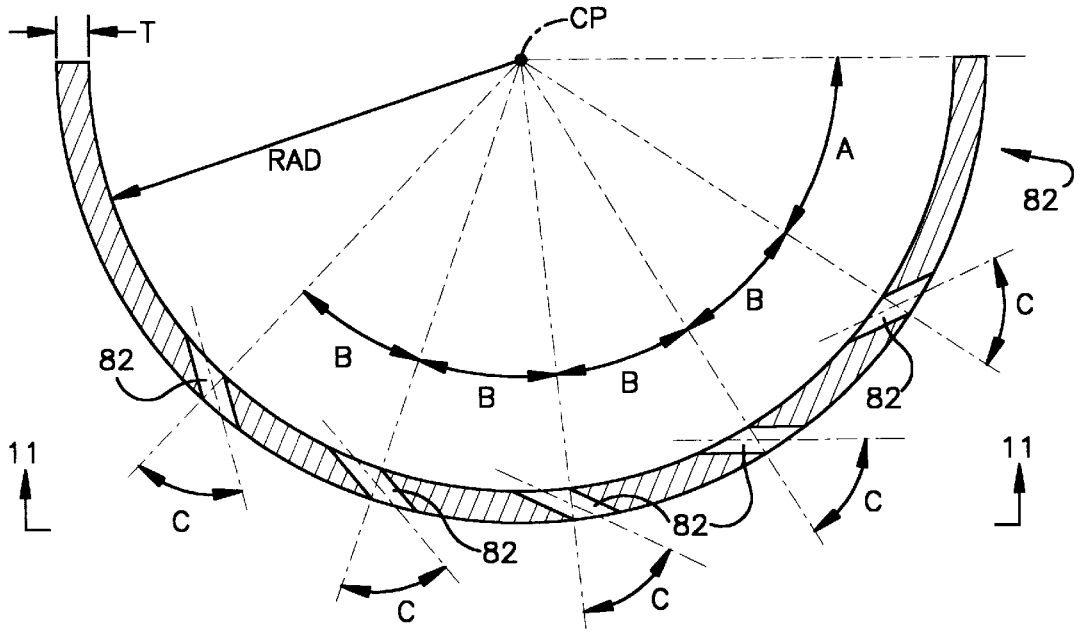
FIG. 10 is a sectional view of a nozzle plate of the fluid manifold of FIG. 8.
Figure 11:
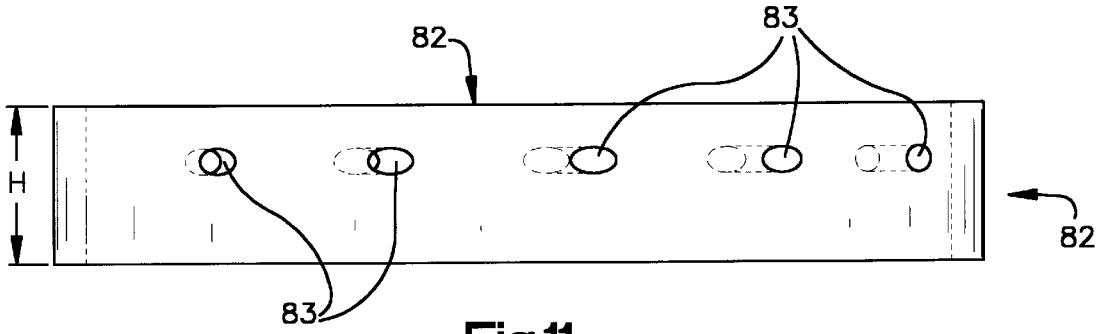
FIG. 11 is a front elevation view of the nozzle plate of FIG. 10 as seen from a plane indicated by the line 111-11 in FIG. 10.

FIGS. 6 and 8–11 shows the manifold 80 and its components. The manifold directs a plurality of jets of fluid, preferably water, at the roller flutes 24 to rotate the roller member 22 at a desired angular velocity. The manifold 80 includes a manifold housing 81 which defines an interior region filled with water and an arcuate nozzle plate 82. The nozzle plate 82 includes six ⅜ inch openings or jets 83 which direct the water at the roller flutes 24. The nozzle plate 82 has a thickness T of ⅝ inches, a radius labeled RAD of 4⅞ inches in FIG. 11, and a height labeled H of 2½ inches in FIG. 11. To maximize the rotation of the roller 22*a*, the tear-like shape of the flutes 24 require that the apertures 83 of the nozzle plate 82 be angled as shown in FIG. 10. That is, for each of the fluid directing openings 83 of the nozzle plate 82, a longitudinal axis extending through the opening 83 forms an acute angle with respect to a radius extending from a center point (labeled CP) of a center of curvature of the nozzle plate to the opening 83. Suitable values for angles labeled A, B and C in FIG. 10 are: A=30 degrees, B=25 degrees and C=55 degrees.

A water inlet 84 includes a 1 inch NPT water pipe half coupling. Water is input to the manifold housing interior region by a ¾ inch diameter hose 85 terminating in a fitting 86 which screws into the threaded inlet 84. Preferably, water in the supply line or hose 85 is kept at a pressure of about 150 pounds per square inch, this causes angular rotation of the roller member 22 at an angular velocity, ω, of approximately 10.47 radians per second or 100 RPM. The housing 81 includes mounting brackets 87, 88, 89 for mounting the manifold 20 to the roller pivot arm 51 of the pivoting assembly 50.

As can be seen in FIG. 4, the roller assemblies 20*a*, 20*b* include a pivoting assembly 50. The pivoting assembly 50 includes roller pivot arms 52 pivotally connected to one of the roller guide frame 70, 72. The two pivot arms 52 associated with the roller assemblies 20*a*, 20*b* are connected to the roller guide frame 70 (FIG. 4) while the two pivot arms 52 associated with the roller assemblies 20*c*, 20*d* are connected to the roller guide frame 72 (FIG. 1). The pivoting assembly 50 includes a piston assembly 60. The roller guide frames 70, 72 are mechanically coupled to the sideguides 16*a*, 16*b*. The piston assembly 60 includes a piston 62, preferably a Hydranamics brand 250 psi air service cylinder, Model No. P25 with a 12 inch bore, a 2⅜ inch stroke and a 3 inch rod diameter. The piston 62 is pinned to extending arm portions 54 of the pivot arms 52 of roller assemblies 20*a*, 20*b* by a linkage 63 including three female rod devises 64 and a tie rod 66 as shown in FIG. 4.

Figure 7:
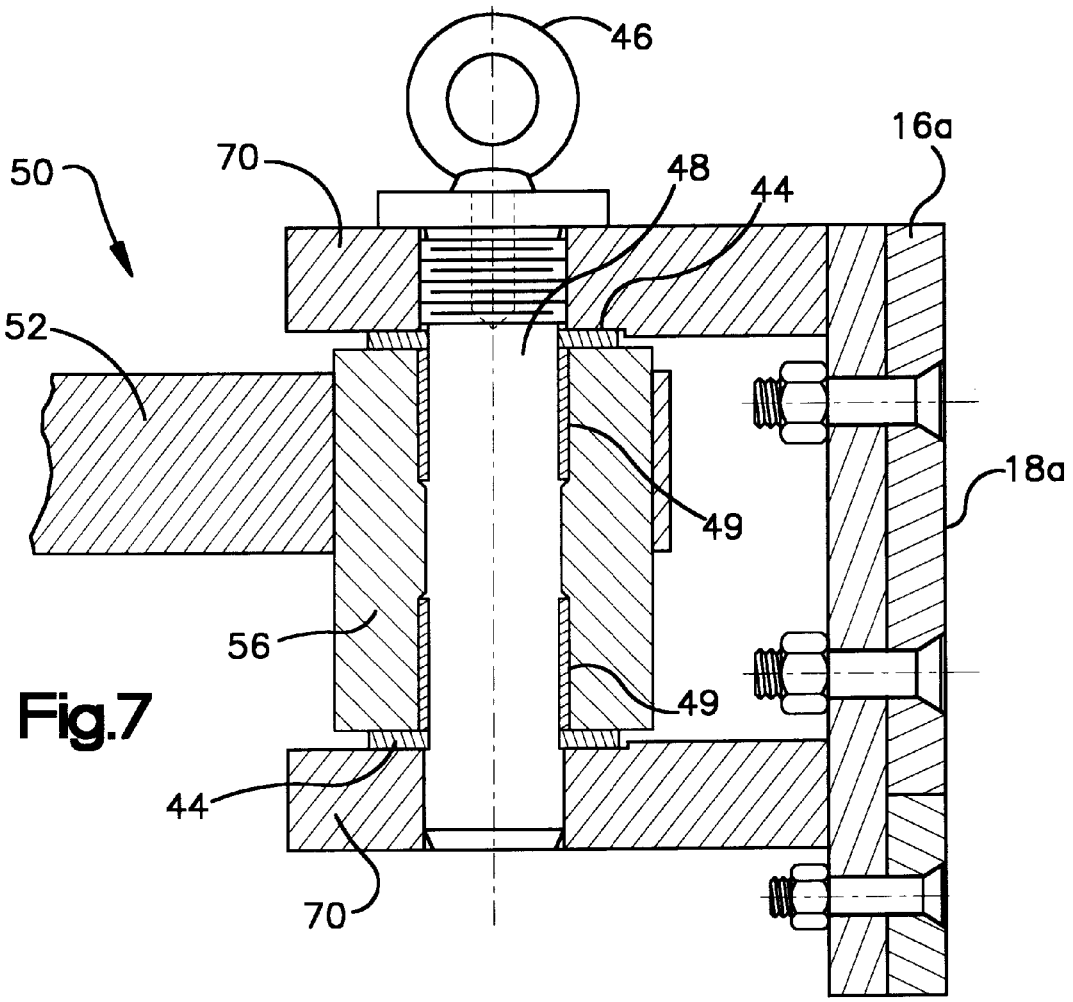
FIG. 7 is a sectional view of a portion of a mounting bracket of the roller assembly as seen from a plane indicated by the line 7—7 in FIG. 4.
Figure 8:
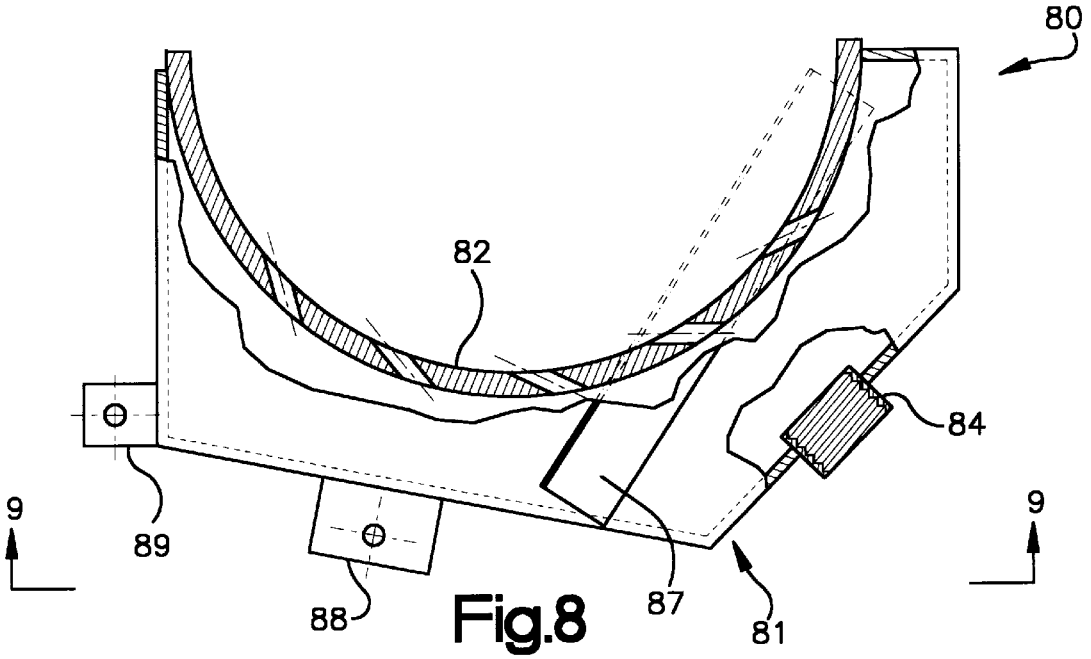
FIG. 8 is a top view partially in plan and partially in section of a fluid manifold which directs pressurized water at a roller of the roller assembly to rotate the roller.
Figure 9:
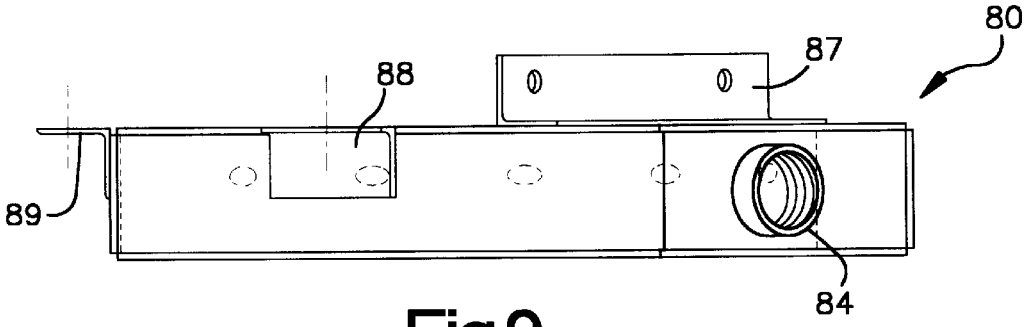
FIG. 9 is a front elevation view of the fluid manifold of FIG. 8 as seen from the plane indicated by the line 9—9.

As can best be seen in FIG. 7, the roller pivot arm 52 are pivotally pinned to the roller guide frame 72 using a 3 inch diameter, 14 inch long pivot pin 48. Threaded into the top of the pivot pin 48 is a Crosby shoulder machinery eye bolt 46, preferably 1 inch×2½ inch. The roller pivot arm 52 pivots on the pivot pin 48. A pair of bearings 49, preferably Garlock brand GAR-FIL™ bearings 3 inch ID×3½ inch OD×3 inch length, Model No. GF4856-48, are disposed between the pivot pin 48 and a collar 56 of the roller pivot arm 54. A pair of thrust washers 44 are disposed above and below the roller pivot arm collar 56. The piston 62 has a short stroke moving the roller assemblies 20*a*, 20*b* between two positions. In the contacting or operating position (shown FIG. 4), a portion of the roller 22*a* extends through an opening 17*a* in the sideguide 16*a* and approximately 2 inches beyond an inwardly facing surface of the sideguide wear plate 18*a* similarly the roller 22*b* also extends 2 inches beyond the inwardly facing surface of the wear plate 18*a*. In a second noncontacting or nonoperating position, the roller 22*a* is retracted into the sideguide opening 17*a* and extends inwardly just beyond the inwardly facing surface of the sideguide wear plate 18*a*. Since the sideguides 16*a*, 16*b* were moved with the drive mechanism 90 to within 2 inches of the steel strip edges 14*a*, 14*b*, in the contacting position of the roller assemblies 20*a*, 20*b*, 20*c*, 20*d*, the piston assembly moves the roller members 22 such that the roller sleeves 26 are in contact with the steel strip edges 14*a*, 14*b*.

As the steel strip 14 passes by the rollers 22, edges 14*a*, 14*b* of the strip 14 contact the roller members 22. Depending on the characteristics of the strip 14, e.g. its width, the shape of the strip edges 14*a*, 14*b* in terms of waviness or oscillations, the contact between the strip edges 14*a*, 14*b* and the roller members 22 may be intermittent or may be constant over a significant length of the strip 14. The pressure of the water directed through the manifold 80 at the flutes 24 may advantageously be adjusted to cause the roller member 22 to rotate at a desired predetermined angular velocity, ω radians/sec. In the instant embodiment, the predetermined angular velocity is approximately ω=10.47 radians/sec or 100 RPM. Given the diameter, d=10 inches, of the roller member 22, the corresponding linear velocity in feet per minute, v(roller), of any given point on the outer surface of the roller is simply computed as:

$$v(\text{roller}) = [\pi \times d \times \text{RPM}]/12 \text{ inches/foot}$$
$$= [3.1415 \times 10 \text{ inches} \times 100 \text{ rev/min}]/12 \text{ inches/foot}$$
$$= 261.8 \text{ ft/min}$$

The pressure of the water from the supply line directed at the roller flutes 24 may be adjusted to attain a desired angular velocity of the roller member 22. Of course the size of the openings 83 of the nozzle plate 82 could be adjusted to facilitate change in the pressure of water impinging on the flutes 24 without the necessity of changing the pressure of the water in the supply line.

Since the roller members 22 are rotating when contacted by the edges 14*a*, 14*b* of the steel strip 14, damage to the edges will be minimized. Further, since the drive linkage between the source of fluid and the roller flutes 32 constitute an indirect drive linkage, the roller member 22 operates as a self clutching mechanism, that is, when the edge 14*a* of the steel strip 14 contacts the roller member 22, the roller members will change their respective angular velocities from the predetermined angular velocity, ω(predetermined), appropriately to rotate at an angular velocity, ω(new), that corresponds to the instantaneous linear velocity, v(strip), of the steel strip at the time of contact, that is v(roller)=v(strip) wherein v(roller)=d×ω(new). Further, for so long as the steel strip edge 14*a* remains in contact with the roller member 22, the roller member will change angular velocity, ω(new), to conform to any variations in the instantaneous linear velocity, v(strip), of the steel strip 14 as it traverses the conveyor 12. When the strip 14 does not contact the roller member 22, the angular velocity of the roller will gradually return to the predetermined angular velocity, (predetermined).

While the invention has been described herein in it currently preferred embodiment or embodiments, those skilled in the art will recognize that other modifications may be made without departing from the invention and it is intended to claim all modifications and variations as fall within the scope of the invention.

We claim:

1. A roller assembly for use in directing a steel strip along a conveyor having a conveyor sideguide, the roller assembly comprising:

a) a roller member having a plurality of flutes spaced apart on an outer surface of the roller member;

b) a support assembly including:

i) a roller support assembly to rotatably support the roller member; and ii) a mounting assembly for securing the roller assembly with respect to the conveyor and positioning the roller member in a first position such that the roller member extends beyond an inner surface of the conveyor sideguide facing the steel strip to be adjacent an edge the steel strip; and c) a fluid manifold for directing pressurized liquid at the roller member to sequentially impinge each of the plurality of flutes and cause the roller member to rotate with respect to the roller support assembly at a predetermined angular velocity, the angular velocity of the roller member automatically adjusting to correspond to a linear velocity of the steel strip when an edge of the steel strip contacts the roller member.

2. The roller assembly of claim 1 wherein the mounting assembly further includes a pivoting assembly for pivoting the roller member between the first position and a second position wherein the roller member is further away from the edge of the steel strip than in the first position.

3. The roller assembly of claim 2 wherein the pivoting assembly includes a pivot arm coupled to the roller support assembly and pivotally affixed to a stationary frame and further includes a piston coupled to the pivot arm for moving the roller member between the first and second positions.

4. The roller assembly of claim 1 wherein the manifold includes a nozzle plate having a plurality of openings through which the pressurized liquid is directed at the flutes of the roller member.

5. The roller assembly of claim 4 wherein the manifold includes a housing defining an interior region for containing a volume of the pressurized liquid and the nozzle plate is arcuate in shape conforming to a shape of the roller member in a region of the roller member including the flutes and overlying at least a portion of the roller member region.

6. The roller assembly of claim 5 wherein for each of the fluid directing openings of the nozzle plate, a longitudinal axis extending through the opening forms an acute angle with respect to a radius extending from a center point of a center of curvature of the nozzle plate to the opening.

7. The roller assembly of claim 6 wherein the acute angle is substantially 55 degrees.

8. The roller assembly of claim 1 wherein the plurality of flutes comprise spaced apart indentations in an outer periphery of the roller member.

9. The roller assembly of claim 8 wherein the plurality of flutes comprises 12 tear-shaped indentations.

10. The roller assembly of claim 1 wherein the roller support assembly further includes a ball bearing assembly disposed between the roller member and a stationary support pin.

11. The roller assembly of claim 1 wherein the roller member includes a roller and a cylindrical sleeve overlying a portion of the roller, the sleeve adapted to contact the edge of the steel strip.

12. A sideguide assembly adapted to be mounted to a conveyor sideguide for use in directing a steel strip along a length of a conveyor, the sideguide assembly comprising:

a) first and second spaced apart sideguides extending upwardly from the conveyor and bounding opposite edges of the steel strip, the first and second sideguides being spaced from respective edges of the steel strip; and b) first and second roller assemblies, the first roller assembly positioned adjacent the first sideguide and the second roller assembly positioned adjacent the second sideguide, each of the roller assemblies including:

1) a rotatable roller member having a plurality of flutes spaced apart on an outer surface of the roller member;

2) a support assembly including:

i) a roller support assembly to rotatably support the roller member; and ii) a mounting assembly for securing the roller assembly with respect to the conveyor and positioning the roller member in a first position such that the roller member extends beyond an inner surface of its respective conveyor sideguide facing the steel strip to be adjacent an edge the steel strip; and 3) a fluid manifold for directing pressurized liquid at the roller member to sequentially impinge each of the plurality of flutes and cause the roller member to rotate with respect to the roller support assembly at a predetermined angular velocity, the angular velocity of the roller member automatically adjusting to correspond to a linear velocity of the steel strip when an edge of the steel strip contacts the roller member.

13. The sideguide assembly of claim 12 wherein the mounting assembly of each of the roller assemblies includes a pivoting assembly for pivoting the roller member between the first position and a second position wherein the roller member is further away from the edge of the steel strip than in the first position.

14. The sideguide assembly of claim 13 wherein the pivoting assembly includes a pivot arm coupled to the roller support assembly and pivotally pivotably affixed to a stationary frame and further includes a piston coupled to the pivot arm for moving the roller member between the first and second positions.

15. The sideguide assembly of claim 12 wherein the manifold of each of the roller assemblies includes a nozzle plate having a plurality of openings through which the pressurized liquid is directed at the flutes of the roller member.

16. The sideguide assembly of claim 15 wherein the manifold includes a housing defining an interior region for containing a volume of the pressurized liquid and the nozzle plate is arcuate in shape conforming to a shape of the roller member in a region of the roller member including the flutes and overlying at least a portion of the roller member region.

17. The sideguide assembly of claim 12 wherein the roller member for each of the roller assemblies includes a roller and a cylindrical sleeve overlying a portion of the roller, the sleeve adapted to contact the edge of the steel strip.

18. The sideguide assembly of claim 17 wherein for each of the fluid directing openings of the nozzle plate, a longitudinal axis extending through the opening forms an acute angle with respect to a radius extending from a center point of a center of curvature of the nozzle plate to the opening.

19. The sideguide assembly of claim 18 herein the acute angle is substantially 55 degrees.

20. The sideguide assembly of claim 12 wherein for each of the roller assemblies the plurality of flutes comprise spaced apart indentations in an outer periphery of the roller member.

21. The sideguide assembly of claim 20 wherein the plurality of flutes comprises 12 tear-shaped indentations.

22. A roller assembly for use in directing a steel strip along a conveyor having a conveyor sideguide, the roller assembly comprising:

a) a roller member comprising at least one roller driving surface;

b) a support assembly including:

i) a roller support assembly that rotatably supports the roller member; and ii) mounting assembly means for securing the roller assembly with respect to the conveyor and for positioning the roller member such that the roller member can be contacted by an edge of the steel strip; and c) means for directing pressurized liquid at the roller member to impinge upon said at least one roller driving surface and cause the roller member to rotate with respect to the roller support assembly.

23. The roller assembly of claim 22 wherein the at least one roller driving surface includes a plurality of spaced apart flutes in the roller driving surface.

24. The roller assembly of claim 22 wherein said means for directing pressurized liquid at the roller member comprises a liquid supply conduit and a nozzle plate disposed between said supply conduit and said roller member, wherein said nozzle plate includes a plurality of openings that are configured and arranged to direct the pressurized liquid at said at least one roller driving surface.

* * * * *